US012721420B2

(12) United States Patent
Baldi

(10) Patent No.: US 12,721,420 B2
(45) Date of Patent: Sep. 1, 2026

(54) SELF-ADJUSTING CLENCHING DEVICE FOR TOTING A BEVERAGE BOTTLE OF A PERSONAL SIZE

(71) Applicant: Michael Owen Baldi, Walpole, MA (US)

(72) Inventor: Michael Owen Baldi, Walpole, MA (US)

( * ) Notice: Subject to any disclaimer, the term of this patent is extended or adjusted under 35 U.S.C. 154(b) by 0 days.

(21) Appl. No.: 18/628,134

(22) Filed: Apr. 5, 2024

(65) Prior Publication Data

US 2025/0311838 A1 Oct. 9, 2025

(51) Int. Cl.
*A45F 5/02* (2006.01)
*A45F 5/00* (2006.01)

(52) U.S. Cl.
CPC ..... *A45F 5/021* (2013.01); *A45F 5/1583* (2025.01)

(58) Field of Classification Search
CPC ..... A45F 5/021; A45F 5/1583; A45F 5/1566
See application file for complete search history.

(56) References Cited

U.S. PATENT DOCUMENTS

| | | | | | |
|---|---|---|---|---|---|
| 2,417,269 | A * | 3/1947 | Robertson | F16L 3/233 | 248/61 |
| 4,773,549 | A * | 9/1988 | Avraham | A47G 23/0241 | 215/396 |
| 5,890,635 | A * | 4/1999 | Wu | A45F 3/14 | 224/257 |
| 5,927,548 | A * | 7/1999 | Villaveces | A45F 5/02 | 222/325 |
| 6,394,329 | B1 * | 5/2002 | Magee | A45F 5/02 | 224/678 |
| 7,614,532 | B1 * | 11/2009 | Dague | A45F 5/02 | 224/667 |
| 2006/0261019 | A1 * | 11/2006 | Chao | A45F 5/02 | 211/74 |
| 2010/0012807 | A1 * | 1/2010 | Perman | A45F 5/021 | 248/312 |
| 2019/0021477 | A1 * | 1/2019 | Senn | A45F 5/021 | |

* cited by examiner

*Primary Examiner* — Derek J Battisti

(57) ABSTRACT

A centrally loaded self-adjusting positive-hold stowable semirigid framework which both supports and clench's the necks of ubiquitous beverage bottles of a personal size regardless of their varying neck diameters, thereby providing an end user with a reusable, convenient, field friendly, hands-free toting device of universal application for enjoying an unencumbered toting experience with the added benefit of promoting a higher degree of socially responsible behavior in the disposal, recycling, or the repurposing of used ubiquitous beverage bottles.

5 Claims, 10 Drawing Sheets

1
38
2
70
68

SELF-ADJUSTING CLENCHING DEVICE FOR TOTING A BEVERAGE BOTTLE OF A PERSONAL SIZE

FIELD OF THE INVENTION

The present device improves the manner in which individuals can more swiftly and conveniently attach, detach, reposition, tote, stow, and access the contents of a commercially made personally sized beverage bottle having a cast-in-place neck ring, which attributes serve to further encourage that the disposal of a used bottle is performed in a most environmentally responsible way.

BACKGROUND AND SUMMARY OF THE INVENTION

Many forms of hands-free devices are currently available that provide an end user with the ability to tote a commercially made beverage bottle of a personal size by utilizing the neck of a bottle as the means by which the toting device retains the bottle. However because the neck diameters of ubiquitous beverage bottles vary between bottle manufacturers, particularly with respect to the most common class of bottles of the lesser neck size, this non-standardized variation results in toting devices of the current art to embody several shortcomings since;

1) the toting devices which utilize rigidly-fixed prongs to support a bottle don't possess the absolute ability to keep every bottle of every neck diameter firmly retained within the grip of the device. This shortcoming is due to both the aforementioned variation of neck diameters as well as the similarly proportioned neck ring which also respectively varies between manufacturers. Therefore many bottles affixed to a rigidly-fixed prong-like device, when subjected to either a jostling or an upward thrusting force, tend to become easily dislodged due to their lack of a positive-hold self-adjusting feature. Therefore toting devices of this type are not universal in nature, and as such they are less than desirable to the roaming consumer. Thus by not providing a universal means by which a wide-range of manufactured bottles can be readily toted, most especially when they have been emptied of their contents, the environmental goals of promoting the responsible transport of bottles to a proper disposal station is instantly diminished as is commonly witnessed.
2) Whereas other types of toting devices of the current art, to remedy the aforementioned loose-fit shortcomings, revert instead to incorporating a sole elasticized connector that is fitted around the neck of a bottle as the primary means by which the necks of bottles are affixed to the toting device itself. However these types of devices, even though their retention capabilities are effective, are inherently cumbersome, most especially when the elasticized part is either being forced onto, or otherwise is being forcibly removed from, the deep recess that is commonly found just below the neck ring of a bottle into which the elasticized part is traditionally fitted. In addition, because the elasticized part, being the sole and primary means of support, is subject to continuous stress induced wear, and as such the elasticized connector can unexpectedly fail in the field after prolonged use, which becomes a great inconvenience to the consumer. This renders toting devices of this type, although practical, to be less than desirable, most especially for those end users with limited hand strength and dexterity levels. These hindrances also, in the long term, tend to diminish the environmental goals here as well since many consumers tend to shy away from a device that is not fail-safe.
3) And with respect to those toting devices of the current art that incorporate a sole elasticized connector that fits around the neck of a bottle, and also revert to using an intermediary mechanical closure clip to affix the elasticized connector to an accoutrement of an end user, the previously noted shortcomings are amplified since the operation of the mechanical clip itself;
   a) typically needs to be manually, and in many instances, awkwardly manipulated using both hands in order to successfully free the bottle from the accoutrement to which it has been attached. Thereby;
   b) negating the ability of an end user to quickly access the contents of the bottle or to otherwise reattach the toting device to the accoutrement, or change a bottles preferred location whenever positional adjustments become necessary as the end users activities or hydration desires change throughout the day, or as the conditions of the end users toting environment may mandate, such as might happen when less sanitary environs are encountered, as might be exampled in the case of accessing public restrooms, or when the device is rendered to a non-toting status. Whereas the present device can be easily accessed, mounted, affixed, or moved to other selected parts of accoutrements, courtesy hangers, courtesy hooks, table tops, and/or cup-holders, without impediment.

Thus the present device remedies all of the aforementioned shortcomings relative to the open-front prong-like devices, or those which utilize elasticized and/or mechanical parts in their respective designs since the present device;

a) because of its unique centralized mounting feature;
b) coupled with the intrinsic self-adjusting attributes incorporated into the semirigid flexure frame;
c) and the positive clenching and retention characteristics of the featured slotted carrier;

readily allows the present device to receive and retain virtually any personally sized beverage bottle, of any various neck width, within the most ubiquitous class of manufactured beverage bottles. This combination of features provides the end user with swift unencumbered access to the contents of not just a limited few bottles, but rather to a whole range of personally sized beverage bottles, that are typically encountered abroad, due to the simplified operational characteristics which are universal in nature. These attributes are of great practical value to end users who have the need to responsibly tote hydration bottles while pursuing passive activities. These include such activities as browsing, leisure walking, attending gatherings, when carrying articles, as well as being equally important to those individuals who may be engaged in more physically challenging activities, such as construction work, hiking, house painting, bucket truck operators, warehouse workers, roofers, landscapers, charity walkers, police officers, military personnel, active homeowners, field hands, FEMA recipients, and tourists alike, to name but a few examples of the greater hydrating population who are in need of the many conveniences and environmental advantages that this present inexpensive toting device has to offer to the roaming public.

With more than 140,000,000 personally sized 'plastic' beverage bottles, of just the lesser neck diameter class, being purchased every single day in just the United States alone, many millions of these beverage bottles wind up being irresponsibly discarded every day, with a great number of these floatable units being subsequently retrieved from public lands at additional expense, collectively making the issue of discarded beverage bottles a national scourge.

With millions of bottles being irresponsibly discarded on a 24/7-365 day basis, an unwarranted environmental impact is being continually and exponentially imposed on hiking trails, roadways, drainage systems, waterways, ocean gyres, and wildlife habitats, both nationally and internationally. And the simple reason for a great majority of this irresponsible behavior is primarily due to the inconvenience an end user must endure when toting a disposable bottle once it has been either emptied, or otherwise partially emptied of its contents. However, by providing a small, reusable, inexpensive, lightweight, hands-free, stowable, self-adjusting toting device that has a universal application for each respective neck size class of personal beverage bottles, but most particularly with respect to the more ubiquitous small necked variety that are typically encountered abroad, a commercially manufactured beverage container of a personal size, once either emptied or partially emptied of its contents, can now be easily and conveniently toted hands-free, without undue bother, to a proper disposal and/or recycling receptacle, or the bottle may otherwise be simply repurposed as a refillable container. Therefore consumers will no longer find it bothersome to properly dispose of an empty container, or for that matter the device itself, merely after a single use, since any personally sized bottle can now be conveniently toted and subsequently disposed of, or otherwise refilled, in any number of more socially responsible ways, especially in those environs where public hydration replenishment stations currently exist, and further noting that the reusable device is easily stowed for future reuse and therefore not prone to be discarded after a single use.

In summation the convenience features, coupled with the practical and universal characteristics embodied in the present toting device, provide the absolute potential for addressing, mitigating and ultimately solving much of the pressing environmental issues concerning the errant disposal of ubiquitous beverage bottles. Especially since the present device itself may be produced from biodegradable material, recycled plastic bottles, or otherwise from a non-floatable material.

By availing themselves of this simplified hands-free self-adjusting reusable device the previously reluctant consumer, and concerned lawmakers alike, are now provided with an inexpensive universal convenience device for toting commercially manufactured beverage bottles that further encourages the reuse, recycling, and the proper disposal of the wide-range of ubiquitous beverage bottles, a pressing issue which has never before been resolved simply because of the inconvenient and non-universal features embodied in those devices of the current art.

Thus, with the present device, toting a bottle, whether new or used, is no longer an impractical, burdensome, cumbersome, or inconvenient experience. In addition, by raising awareness through the visibility of this equally ubiquitous universal toting device, it self-serves to promote a more responsible social enterprise, since the present reusable self-adjusting hands-free device allows for a personal beverage bottle, of any variable neck diameter, within a classified bottle size, to be swiftly and easily loaded and unloaded, toted, accessed, mounted, removed, restored, stowed, carried, slung, attached, detached, repositioned, replaced, refilled, repurposed, recycled, or otherwise just as easily rendered to a desk top, table top, or to a cup-holder environ, with each cited action being easily and swiftly performed by dexterous or impaired hands alike, in both the use and deployment of this environmentally correct, positive-hold, fail-safe, and user friendly beverage bottle toting device.

REFERENCE NUMERALS

Figures 1, 2:
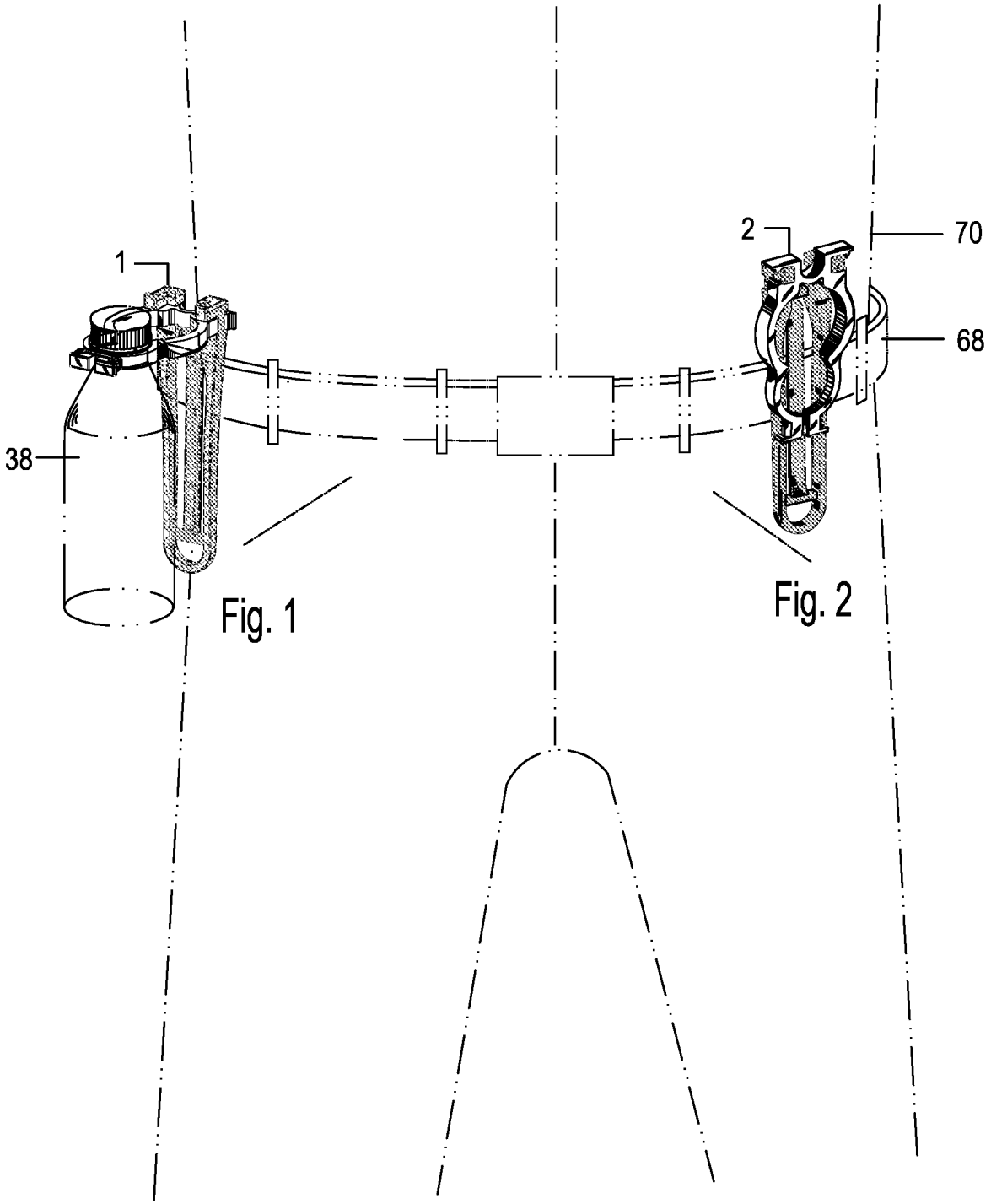
FIG. 1 An introductory perspective view depicting the present device as it would typically appear when affixed to an accoutrement of an end user while clenching and supporting a commercially manufactured beverage bottle.
FIG. 2 An introductory perspective view depicting the present device as it would typically appear affixed to an accoutrement of an end user when collapsed and stowed.

1 semirigid flexure frame carry-ready assembly
2 semirigid flexure frame stowage assembly
4 auxiliary elasticized O-ring
6 semirigid vertical flexure frame
8 semirigid self-adjusting carrier frame
10 semirigid vertical strut
12 castellated stowage protuberance
13 torsion pillar
14 torsion pillar mating indent
16 semirigid belt-brake tongue
18 ancillary peg
19 anchoring peg
20 conjoining connector
22 carrier mating socket
24 locking tab
26 pass through aperture
28 retention lobe
30 retention aperture
32 self-adjusting clenching arm
34 presser protuberance
36 facilitation slot
38 manufactured beverage bottle
40 bottle cap
42 bottle neck ring (a.k.a. transfer bead) of a manufactured beverage bottle
44 neck of a manufactured beverage bottle
46 ancillary indent to accommodate the tapered feature of a bottle in the region below the neck
50 lateral displacement of the semirigid vertical struts by user applied force
52 carrier removal from laterally displaced stowage protuberances of the semirigid vertical frame
54 carrier attachment to laterally displaced torsion pillars of the semirigid vertical frame
56 bottle alignment and insertion direction up through the receiving aperture of semirigid carrier frame
58 end user applied force
60 direction of a bottle moving past the retention lobes of the semirigid carrier frame
62 semirigid carrier arms expanding outward as a reaction to a bottle moving past and through the retention lobes
66 clenching force inherent to the semirigid carrier frame and bolstered by an auxiliary elasticized O-ring
68 end user accoutrement
70 an end user

DETAILED DESCRIPTION OF THE INVENTION

FIG. 1 An introductory perspective view depicting the semirigid flexure frame assembly 1 when both supporting and temporarily affixing a commercially manufactured beverage bottle 38 to an accoutrement 68 of an end user 70.

FIG. 2 An introductory perspective view depicting the semirigid flexure frame assembly 2 as it would typically appear when collapsed, stowed, and affixed to an accoutrement 68 of an end user 70.

FIG. 3A perspective view relative to FIG. 2 depicting the principal features of a stowage assembly 2 of the present device, and to further highlight the manner in which the semirigid self-adjusting slotted carrier frame 8 is temporarily mated with the castellated stowage protuberances 12 of the semirigid vertical flexure frame 6.

Figure 4:
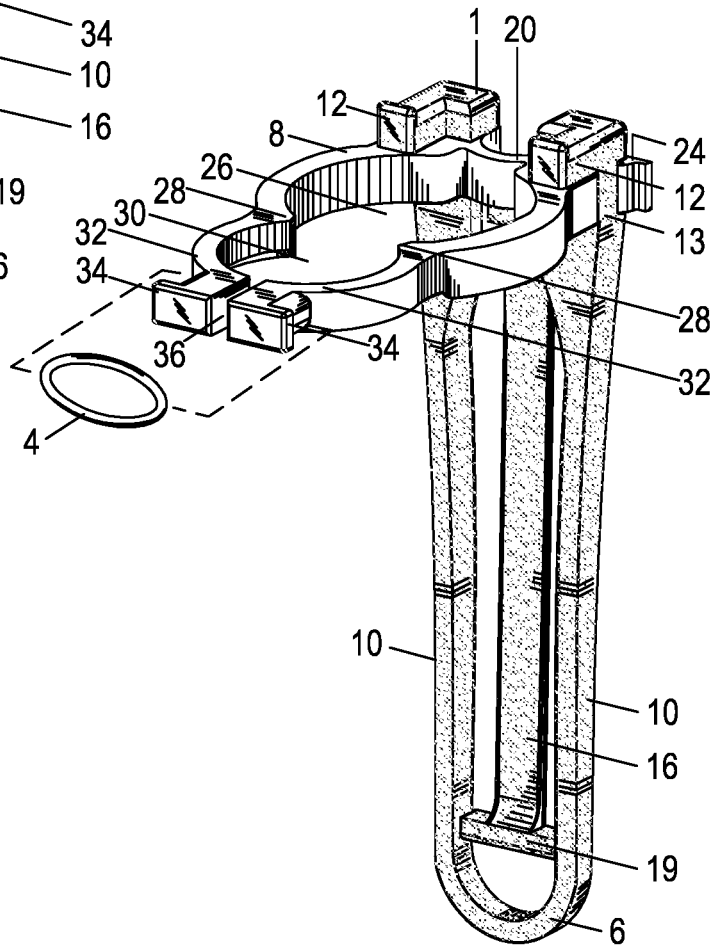
FIG. 4A perspective view of the present device as it would typically appear when assembled in its carry-ready form with the installation trajectory of an auxiliary elasticized O-ring highlighted.

FIG. 4A perspective view relative to FIG. 1 depicting the principal features of a carry-ready assembly 1 of the present device, and to further highlight the manner in which the semirigid self-adjusting slotted carrier frame 8 is mated and locked onto 24 the torsion pillars 13 of the semirigid vertical flexure frame 6 and the manner in which an auxiliary elasticized O-ring 4 may be fitted to the presser protuberances 34 of the semirigid self-adjusting slotted carrier frame 8.

FIG. 5A top view of the semirigid self-adjusting slotted carrier frame 8 to highlight the relationships of and between the featured facilitation slot 36 located between the presser protuberances 34 of the semirigid self-adjusting carrier frame 8, the carrier frame mating sockets 22 and their respective locking tabs 24, the conjoining connector 20, and the opposing retention lobes 28 which project inwardly from each independent clenching arm 32 at a point situated between the pass through aperture 26 and the retention aperture 30.

Figures 5, 8, 9:
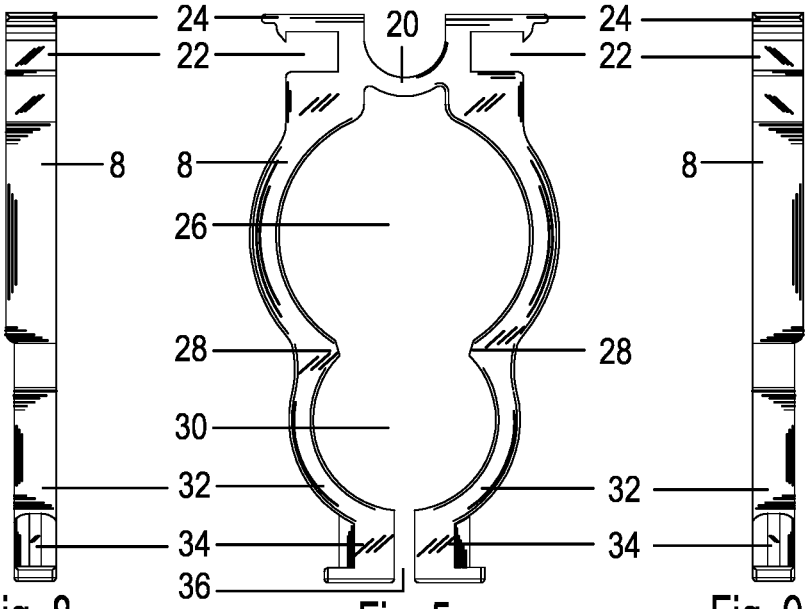
FIG. 5A top view of the semirigid self-adjusting slotted carrier frame component.
FIG. 8A left side view of the semirigid self-adjusting slotted carrier frame component.
FIG. 9A right side view of the semirigid self-adjusting slotted carrier frame component.
Figure 6:
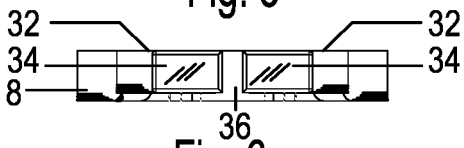
FIG. 6A front view of the semirigid self-adjusting slotted carrier frame component.

FIG. 6A front view of the semirigid self-adjusting slotted carrier frame 8 relative to FIG. 5.

Figure 7:
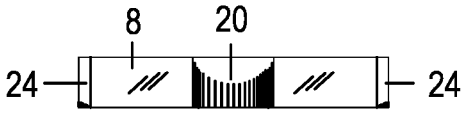
FIG. 7A rear view of the semirigid self-adjusting slotted carrier frame component.

FIG. 7A rear view of the semirigid self-adjusting slotted carrier frame 8 relative to FIG. 5.

FIG. 8A left side view of the semirigid self-adjusting slotted carrier frame 8 relative to FIG. 5.

FIG. 9A right side view of the semirigid self-adjusting slotted carrier frame 8 relative to FIG. 5.

Figure 10:
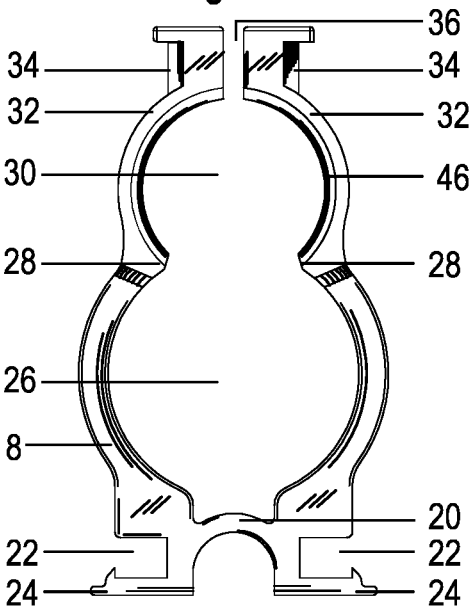
FIG. 10A bottom view of the semirigid self-adjusting slotted carrier frame component.

FIG. 10 An underside bottom view of the semirigid self-adjusting slotted carrier frame 8 relative to FIG. 5.

FIG. 11A front view of the semirigid vertical flexure frame component 6 to highlight the castellated stowage protuberances 12, the torsion pillars 13 and associated pillar mating indent 14 situated at the uppermost region of each respective vertical strut 10, one of which consists of an ancillary peg 18 and an anchoring peg 19 from which the semirigid belt-brake tongue 16 projects.

Figure 12:
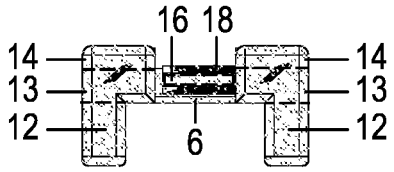
FIG. 12A top view of the semirigid vertical flexure frame component.
Figure 11:
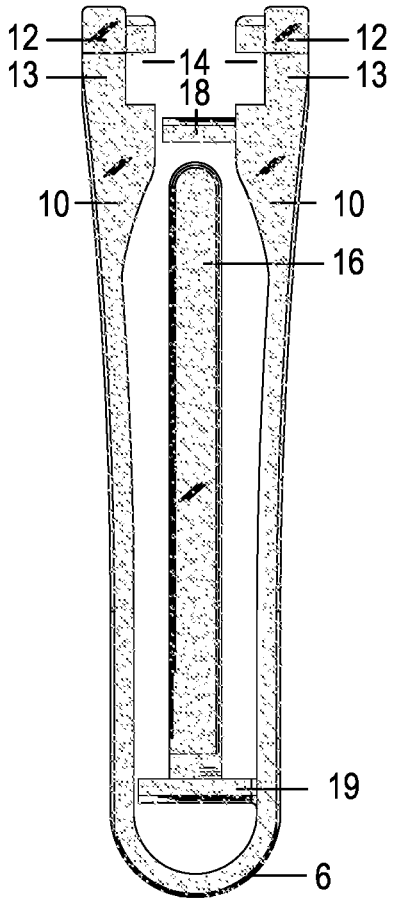
FIG. 11A front view of the semirigid vertical flexure frame component.

FIG. 12A top view of the semirigid vertical flexure frame component 6 relative to FIG. 11.

Figure 13:
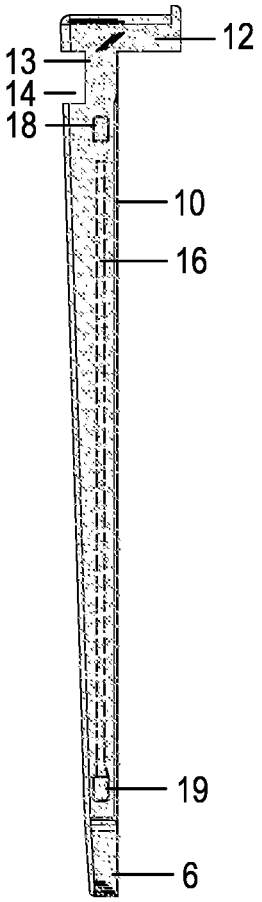
FIG. 13A left side view of the semirigid vertical flexure frame component.

FIG. 13A left side view of the semirigid vertical flexure frame component 6 relative to FIG. 11.

Figure 14:
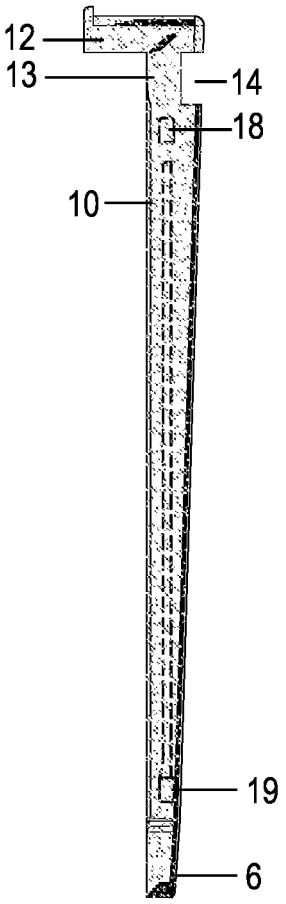
FIG. 14A right side view of the semirigid vertical flexure frame component.

FIG. 14A right side view of the semirigid vertical flexure frame component 6 relative to FIG. 11.

Figure 15:
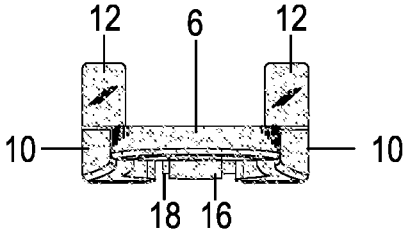
FIG. 15A bottom view of the semirigid vertical flexure frame component.

FIG. 15A bottom view of the semirigid vertical flexure frame component 6 relative to FIG. 11.

Figure 16:
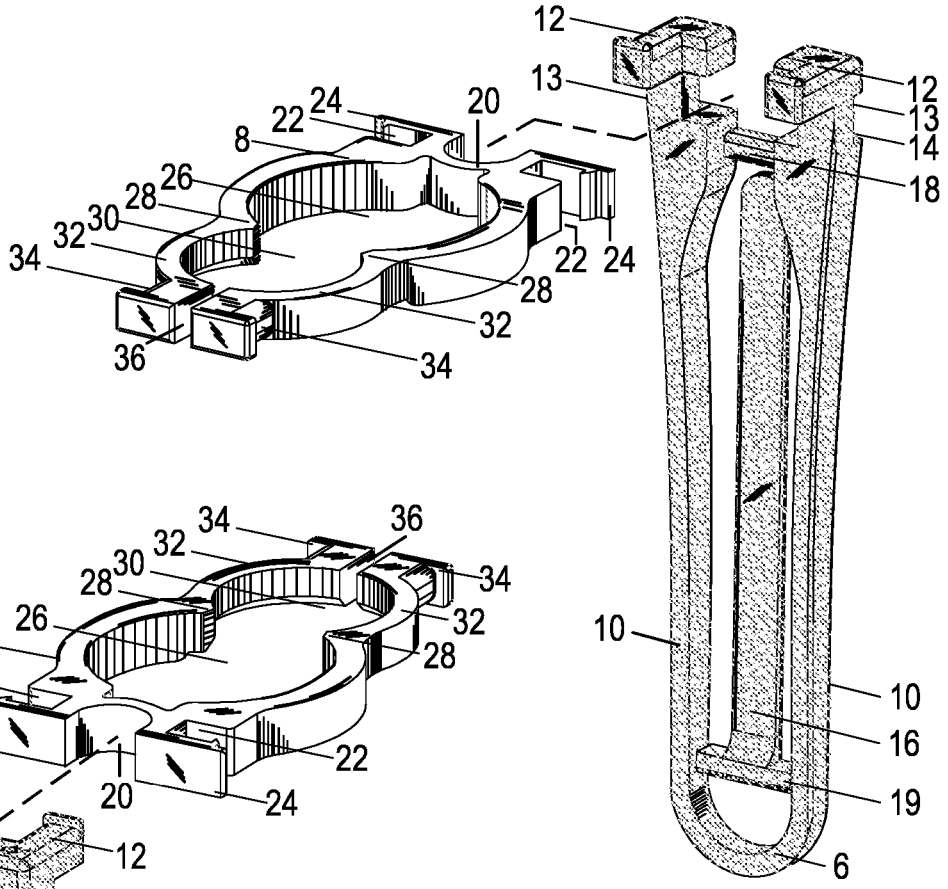
FIG. 16 An exploded frontal perspective view depicting the manner in which the flexure frame components are assembled.

FIG. 16 An exploded frontal perspective view depicting the manner in which the mating sockets 22 of the semirigid self-adjusting slotted carrier frame 8 are aligned with the corresponding torsion pillars 13 and associated mating indents 14 of the semirigid vertical struts 10 of the semirigid vertical flexure frame 6 prior to carry-ready assembly, noting that the uppermost region of the semirigid vertical struts 10 of the semirigid vertical frame 10 are shown here in an unexpanded state.

Figure 17:
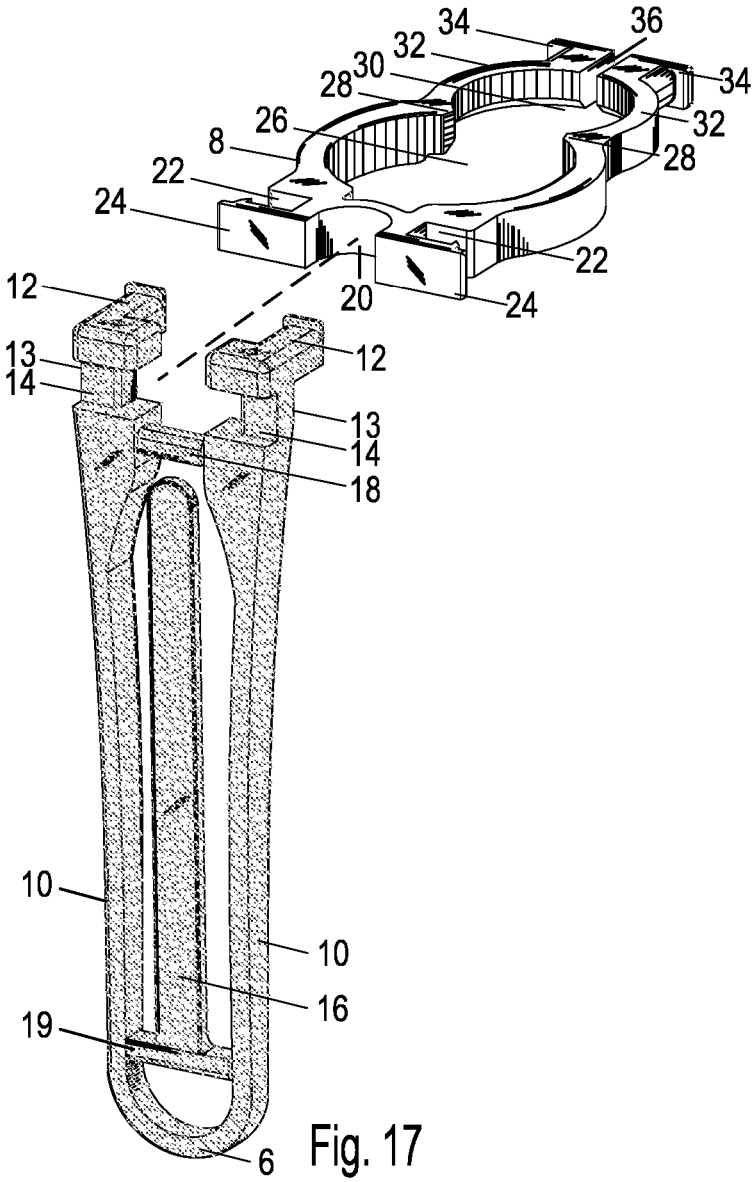
FIG. 17 An exploded rearward perspective view depicting the manner in which the flexure frame components are assembled.

FIG. 17 An exploded rearward perspective view relative to FIG. 16.

Figure 3:
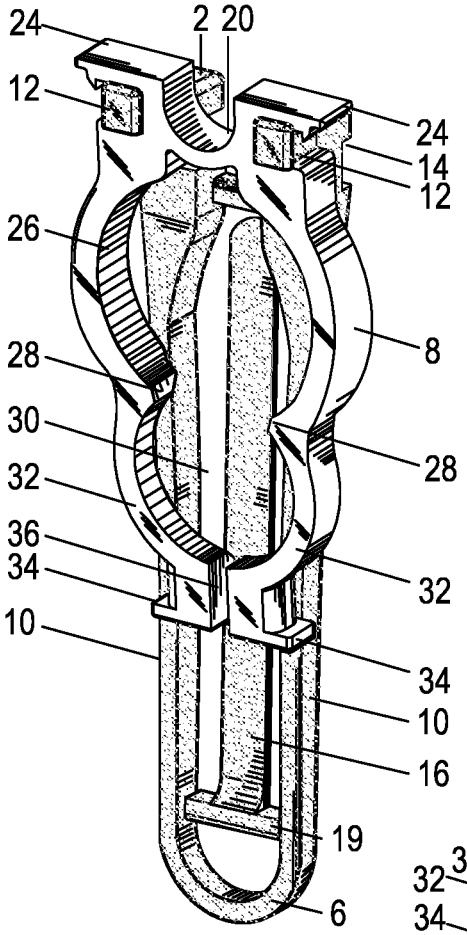
FIG. 3A perspective view of the present device when collapsed and stowed.
Figure 18:
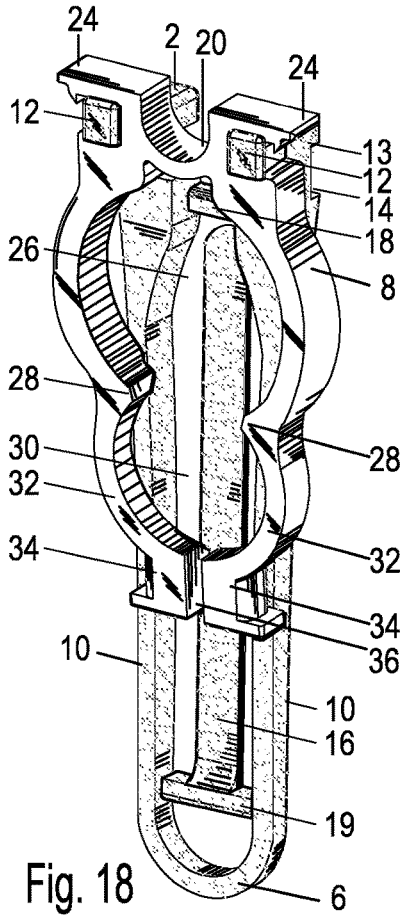
FIG. 18 As the first in a series of four sequential perspective views this illustration depicts the manner in which the semirigid self-adjusting slotted carrier frame component is stowed on the semirigid vertical flexure frame component.

FIG. 18 As the first in a series of four sequential perspective view this illustration, relative to FIG. 3, depicts the principal features of the stowage assembly 2 of the present device, and to further highlight the manner in which the semirigid self-adjusting slotted carrier frame 8 is temporarily mated with the castellated stowage protuberances 12 of the semirigid vertical flexure frame 6.

Figure 19:
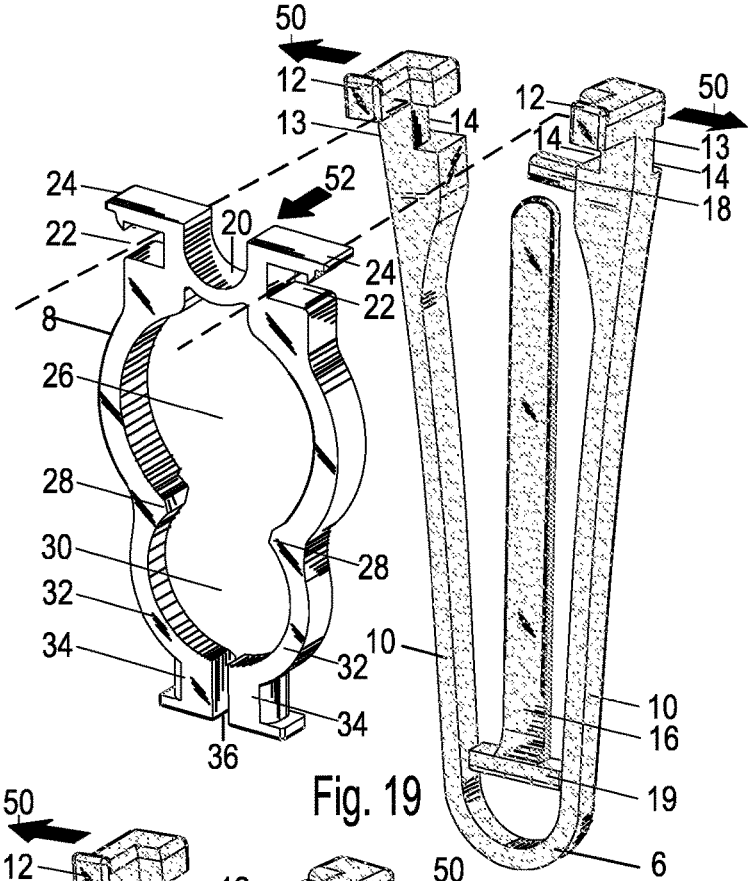
FIG. 19 As the second in a series of four sequential perspective views this illustration depicts the manner in which the previously stowed semirigid self-adjusting slotted carrier frame component is separated from the semirigid vertical flexure frame component.

FIG. 19 As the second in a series of four sequential perspective views this illustration depicts the manner in which end user applied lateral forces 50 have caused the semirigid vertical struts 10 to expand outwardly which results in the mating sockets 22 of the semirigid self-adjusting slotted carrier frame 8 to separate 52 from the castellated stowage protuberances 12 of the semirigid vertical flexure frame 6.

Figure 20:
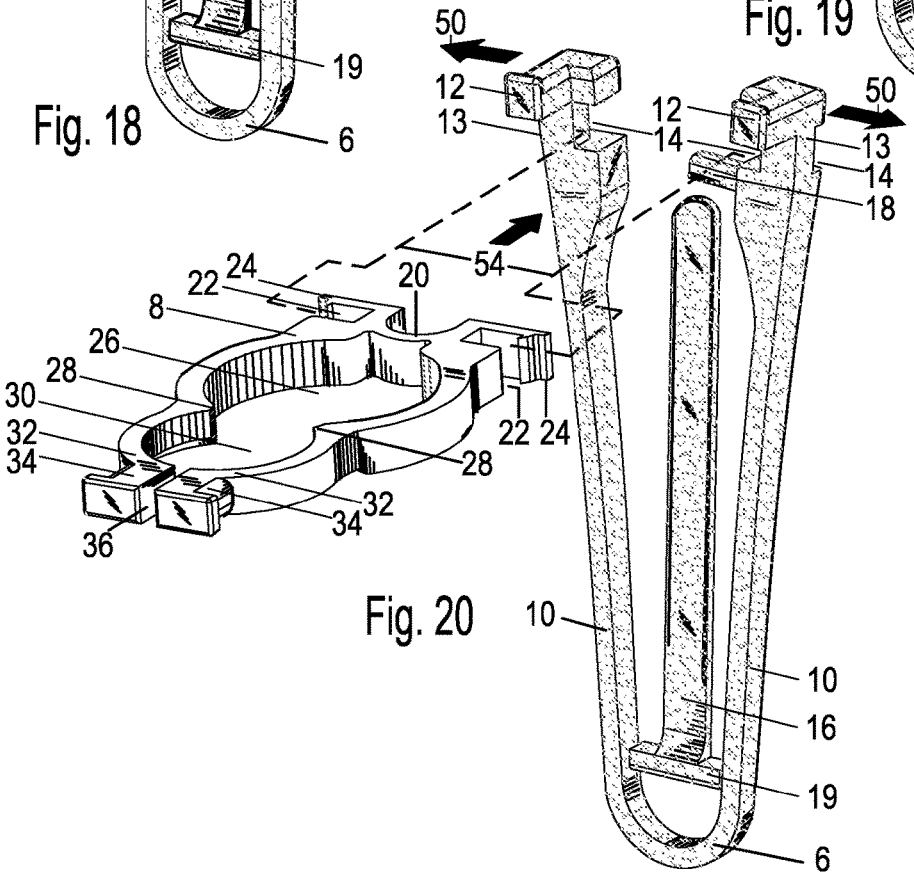
FIG. 20 As the third in a series of four sequential perspective views this illustration depicts the manner in which the sockets of the semirigid self-adjusting slotted carrier frame component is aligned with the corresponding mating indents of the vertical struts of the semirigid vertical flexure frame component when preparing for a carry-ready assembly.

FIG. 20 As the third in a series of four sequential perspective views this illustration depicts the manner in which the carrier mating sockets 22 of the semirigid self-adjusting carrier frame 8 are subsequently aligned 54 with the mating indents 14 of the torsion pillars 13 of the semirigid vertical struts 10 which have been expanded outwardly by lateral forces 50 applied by an end user to facilitate a carry-ready assembly 1.

Figure 21:
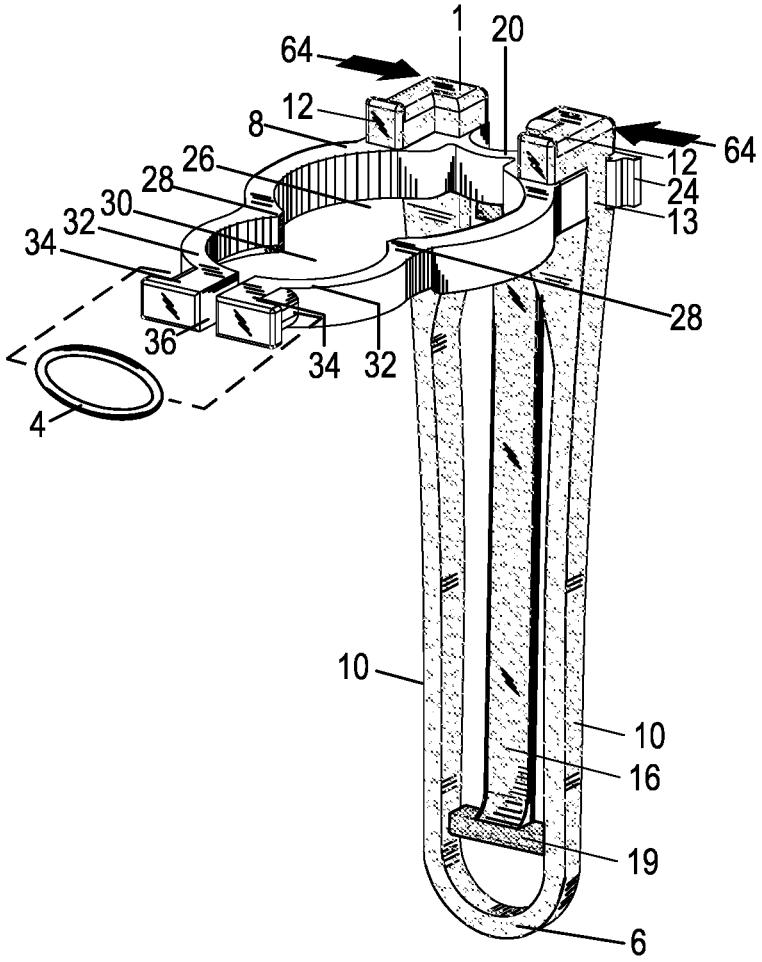
FIG. 21 As the fourth in the series of four sequential perspective views this illustration depicts the sockets of the semirigid self-adjusting slotted carrier frame component fitted and locked onto the mating indents of the semirigid vertical flexure frame component and the manner in which an auxiliary elasticized O-ring may be subsequently fitted to the presser protuberances of the semirigid self-adjusting slotted carrier frame component to further augment the clenching characteristics of a carry-ready assembly.

FIG. 21 As the fourth in a series of four sequential perspective views this illustration depicts a typical carry-ready assembly 1 to highlight the manner in which the locking tabs 24 of the slotted 36 self-adjusting semirigid carrier frame 8 grip the outer faces of the torsion pillars 13 of the contracted 64 semirigid vertical struts 10 of the semirigid vertical flexure frame 6, and the manner in which the auxiliary elasticized O-ring 4 may be optionally installed on the presser protuberances 34 as a means of bolstering the inherent clenching attributes of the self-adjusting semirigid clenching arms 32 of the semirigid self-adjusting slotted carrier frame 8.

Figure 22:
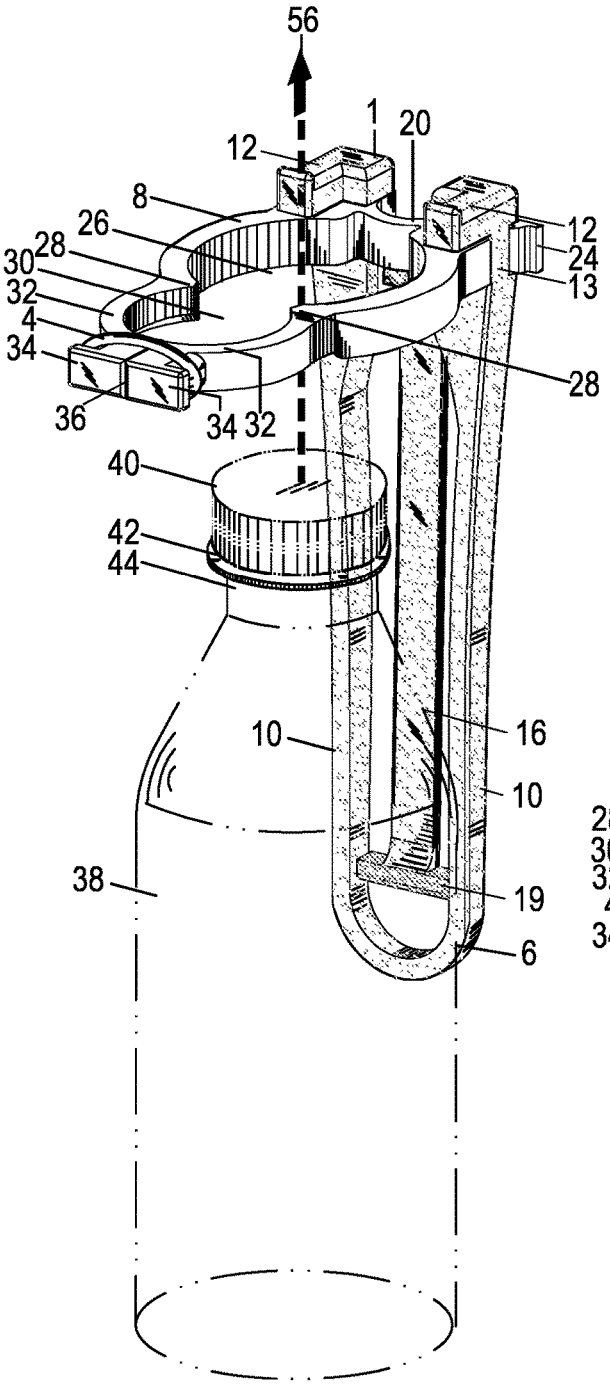
FIG. 22 As the first in a series of four sequential perspective views this illustration depicts the manner in which a manufactured beverage bottle is aligned with the receiving aperture of an augmented and fully clenched semirigid self-adjusting slotted carrier frame component of a typical semirigid flexure frame carry-ready assembly.

FIG. 22 As the first in a series of four sequential perspective views, and relative to FIG. 21, this illustration depicts the manner in which the cap 40, neck ring 42, and neck 44 of a manufactured beverage bottle 38 is pre-aligned with the receiving aperture 26 of the slotted 36 self-adjusting semirigid carrier frame 8 of a typical carry-ready assembly 1 noting that the facilitator slot 36 of the self-adjusting semirigid carrier frame 8 is fully clenched being further bolstered by an auxiliary elasticized O-ring 4.

Figure 23:
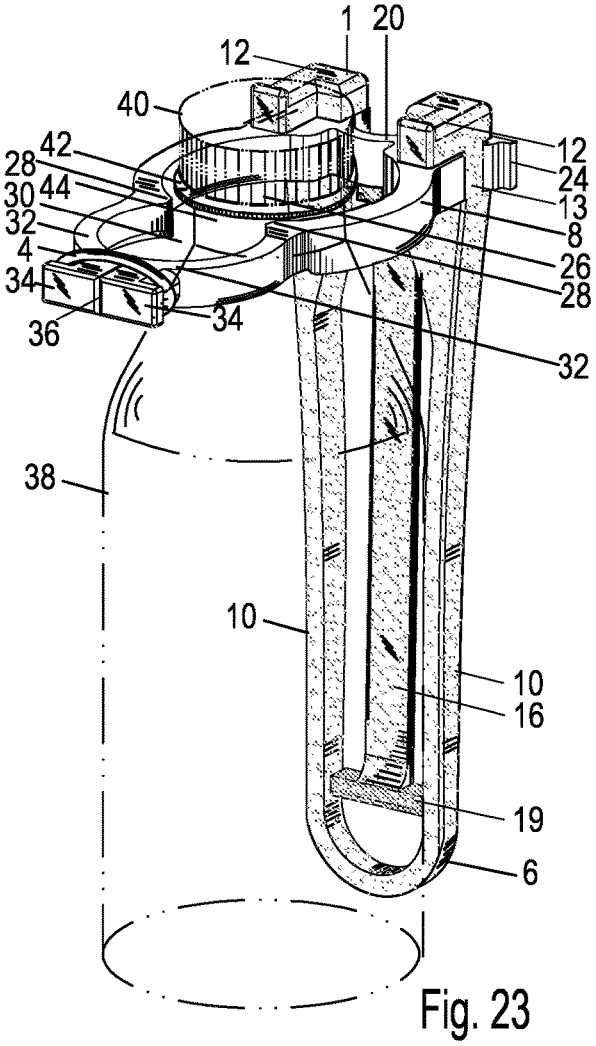
FIG. 23 As the second in a series of four sequential perspective views this illustration depicts the moment when the cap, neck, and neck ring, of a manufactured beverage has passed upward and through the receiving aperture of an augmented and fully clenched semirigid self-adjusting slotted carrier frame of the semirigid flexure frame carry-ready assembly.

FIG. 23 As the second in a series of four sequential perspective views, and relative to FIG. 22, this illustration depicts the manner in which the formerly pre-aligned cap 40, neck ring 42, and neck 44 of a manufactured beverage bottle 38 has passed upward and through the receiving aperture 26 of a carry-ready assembly 1 such that the bottom plane of the neck ring 42 lies at the top plane of the clenching arms 32 of the semirigid self-adjusting slotted carrier frame 8 noting that the facilitator slot 36 of the self-adjusting semirigid carrier frame 8 remains fully clenched being bolstered by an auxiliary elasticized O-ring 4.

Figure 24:
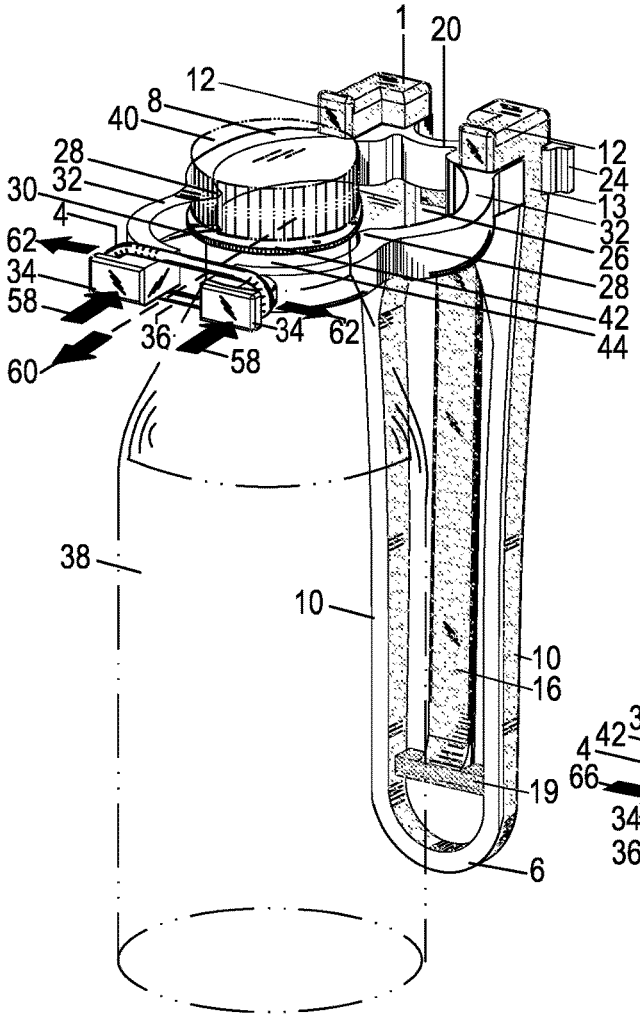
FIG. 24 As the third in a series of four sequential perspective views this illustration depicts the moment when the widest neck section of a manufactured beverage bottle, being forced past the retention lobes of the semirigid self-adjusting slotted carrier frame component, causes the carrier arms of the semirigid self-adjusting slotted carrier frame component, as well as the auxiliary elasticized O-ring, to expand outwardly as an end user forces the bottle from out of the receiving aperture and into the self-adjusting retention aperture of the semirigid self-adjusting slotted carrier frame component of the carry-ready assembly.

FIG. 24 As the third in a series of four sequential perspective views this illustration depicts the instant when end user applied forces 58 acting on the presser protuberances 34 of the semirigid self-adjusting slotted carrier frame 8, result in the maximum width of the neck 44 of a manufactured beverage bottle 38 being forced between the opposing retention lobes 28 of the semirigid self-adjusting slotted carrier frame 8 at the moment when the manufactured beverage bottle 38 moves from out of the receiving aperture 26 and into 60 the retention aperture 30, which actions and conditions simultaneously cause the clenching arms 32 and the bolstering auxiliary elasticized O-ring 4 to self-adjust by expanding outwardly 62 while the spring-like characteristics inherent to the conjoining connector of the self-adjusting semirigid slotted carrier frame 8, and the twisting characteristics inherent to the torsion pillars 13 of each respective semirigid vertical strut 10 of the semirigid vertical flexure frame 6 collectively react to counter the momentary outwardly expanding stresses 62.

Figure 25:
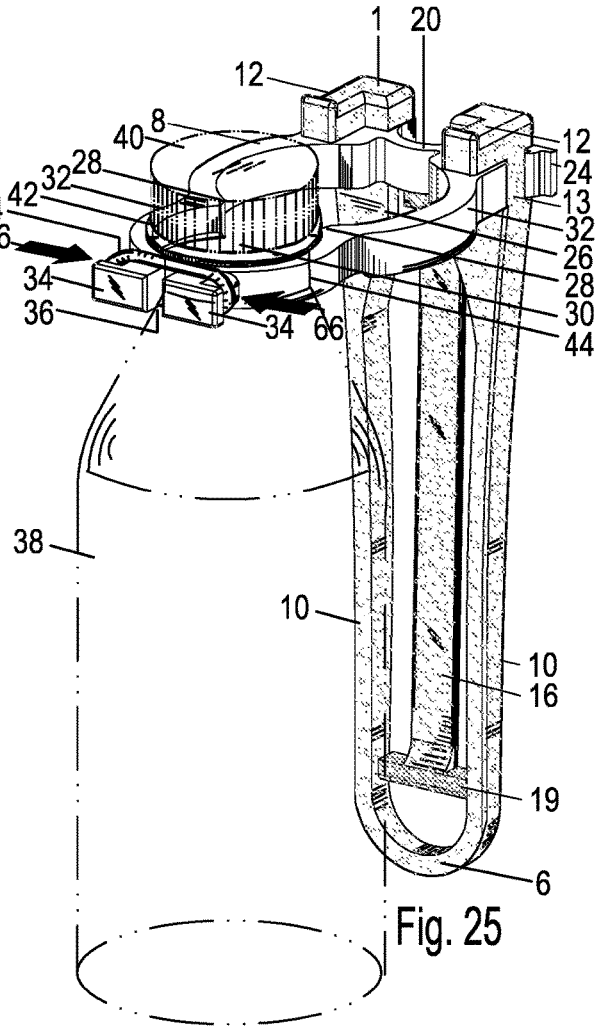
FIG. 25 As the fourth in the series of four sequential perspective views this illustration depicts the manner in which the semirigid slotted carrier frame component self-adjusts at the moment when the neck of a manufactured beverage bottle has passed into the retention aperture of the semirigid self-adjusting slotted carrier frame, where the neck of the bottle is positively clenched by the coincident contraction of both the retention lobes and the clenching characteristics inherent to the semirigid carrier arms of the semirigid self-adjusting slotted carrier frame component, whose inherent internal forces are further bolstered by the newly tensioned auxiliary elasticized O-ring, which in turn collectively serve to further support the neck ring of the bottle atop the carrier arms of the semirigid self-adjusting slotted carrier frame component.

FIG. 25 As the fourth in a series of four sequential perspective views, and subsequent to the neck 44 of a manufactured beverage bottle 38 having fully entered into the retention aperture 30 of the semirigid self-adjusting slotted carrier frame 8, depicts the manner in which the bottom plane of the neck ring 42 of a manufactured beverage bottle 38 is ultimately supported by the top plane of the retracted clenching arms 32 while the neck 44 of the manufactured beverage bottle 38 is simultaneously retained within the confines of the retention aperture 30 by the collective clenching actions of the retracted retention lobes 28, the internal forces 66 inherent to the semi-rigid self-adjusting clenching arms 32 of the semirigid self-adjusting slotted carrier frame 8, the spring-like characteristics inherent to the conjoining connector 20, the tensile forces inherent to the expanded elasticized auxiliary O-ring 4 acting on the presser protuberances 34 of the self-adjusting semirigid slotted carrier frame 8, and the internal twisting forces inherent to the torsional pillars 13 of each respective semirigid vertical strut 10 of the semirigid vertical flexure frame 6 which, along with the featured facilitation slot 36, causes the overall carry-ready assembly 1 to self-adjust to ultimately support, clench, and positively hold a wide range of ubiquitous manufactured beverage bottles 38 regardless of the variable neck 44 sizes that are undoubtedly encountered.

Figure 26:
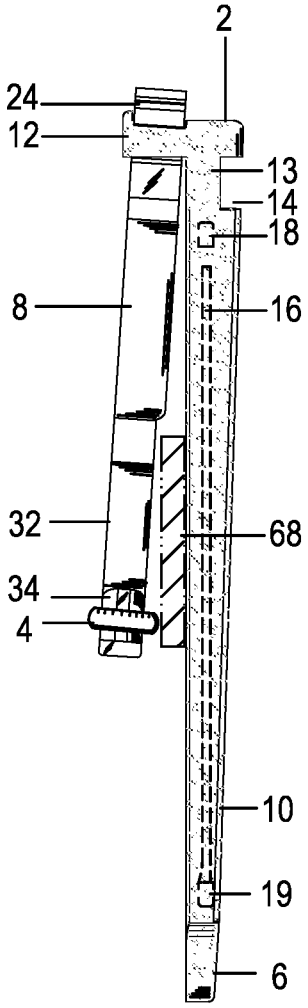
FIG. 26A side view of a collapsed and stowed assembly of the present device as it might appear when affixed to the accoutrement of an end user.

FIG. 26A side view depicting a semirigid flexure frame stowage assembly 2 as the present device would appear when collapsed, stowed, and affixed to an accoutrement 68 of an end user, and to further highlight the manner in which a locking tab 24 of the semirigid self-adjusting slotted carrier frame 8 grips the castellated stowage protuberance 12 of the semirigid vertical flexure frame 6.

Figure 27:
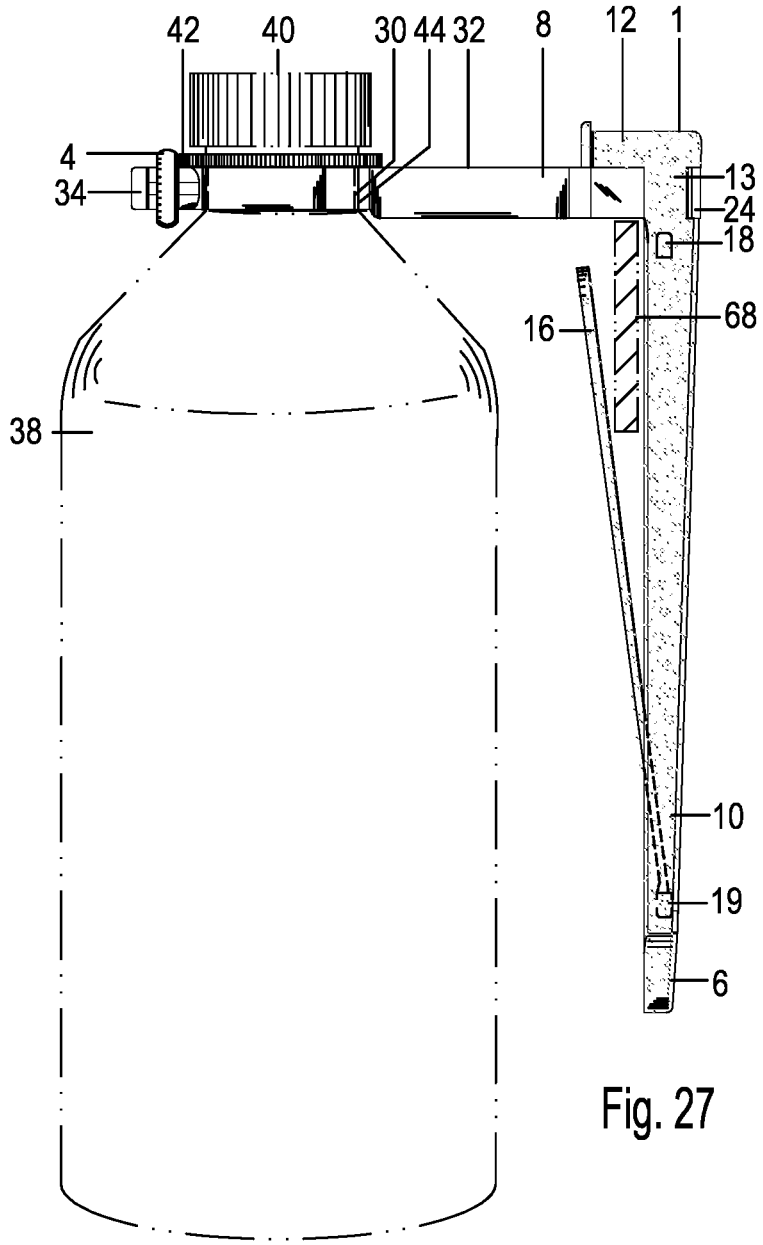
FIG. 27A side view of the present device in a carry-ready assembled form to highlight the manner in which the carrier arms of the semirigid self-adjusting slotted carrier frame ultimately supports a manufactured beverage bottle whose neck is fully clenched within the self-adjusted retention aperture of the semirigid slotted carrier frame component, and the manner in which the semirigid belt brake tongue may be optionally used to interact with an accoutrement of an end user to prevent the device from becoming unexpectedly dislodged from the accoutrement to which it has been affixed.

FIG. 27A typical side view of the semirigid flexure frame carry-ready assembly 1 when temporarily affixed to an accoutrement 68 of an end user to highlight the manner in which the neck ring 42 of a manufactured beverage bottle 38 is supported by the upper plane of the self-adjusted clenching arms 32 when the neck 44 of the manufactured beverage bottle 38 is fully clenched within the retention aperture 30 of the semirigid self-adjusting slotted carrier frame 8 of the semirigid flexure frame carry-ready assembly 1, and to further highlight the manner in which the semirigid belt brake tongue 16 may be optionally employed to interact with an accoutrement 68 of an end user to prevent the carry-ready assembly 1 from becoming unexpectedly dislodged from the accoutrement 68 to which the semirigid flexure frame carry-ready assembly 1 has been temporarily affixed.

CONCLUSIONS, RAMIFICATIONS AND SCOPE

The reader will see that I have provided an improved hands-free device for toting manufactured beverage bottles of a personal size that:

a. is of universal application and thus is a field friendly device.
b. is self-adjusting to ensure a positive-hold experience.
c. is practical.
d. is of a simple and compact design.
e. is easy to stow, assemble, and disassemble.
f. is easy to load and/or unload for all age groups and for those with impaired hand abilities.
g. is easy to tote hands-free when either loaded or unloaded.
h. is durable, substantial, reusable, and isn't prone to being arbitrarily discarded.
i. is environmentally necessary.
j. self-promotes the recycling and/or the reuse of plastic bottles, most especially for the most ubiquitous manufactured bottles of the lesser neck size.
k. is potentially made from biodegradable, recycled, and/or from a non-floatable material.
l. is embodied with features which allow the user to take advantage of other added conveniences such as placing a loaded device on a hanger or on a hook.

I claim:

1. A reusable wearable positive-hold semirigid self-adjusting neck clenching support device for the hands-free toting of an entire spectrum of ubiquitous commercially manufactured plastic beverage bottles of a classified personal size regardless of either the neck or neck ring sizes typically encountered abroad; a) wherein said reusable wearable positive-hold semirigid self-adjusting neck clenching support device is comprised of a horizontally aligned semirigid carrier frame; b) wherein said horizontally aligned semirigid carrier frame is comprised of two symmetrically opposed materially pretensioned coplanar self-adjusting semirigid articulating arms; c) wherein said reusable wearable positive-hold semirigid self-adjusting neck clenching support device is symmetrically configured; d) wherein the interior space of said horizontally aligned semirigid carrier frame of said reusable wearable positive-hold semirigid self-adjusting neck clenching support device is configured with two overlapping interior apertures; e) wherein said semirigid horizontal carrier frame of said reusable wearable positive-hold semirigid neck clenching device comprised of two symmetrically opposed materially pretensioned coplanar self-adjusting articulating arms is conjoined at one end and slotted on the opposite end; f) wherein said symmetrically opposed materially pretensioned coplanar self-adjusting semirigid articulating arms are configured to maximally encircle, clench, and retain the necks of an entire spectrum of ubiquitous commercially manufactured plastic beverage bottles of a classified personal size regardless of either the neck or neck ring sizes typically encountered abroad; g) wherein said symmetrically opposed materially pretensioned coplanar self-adjusting semirigid slotted articulating arms are materially and structurally configured to pivot about the respective conjoined ends of said slotted semirigid horizontal carrier frame; h) wherein said conjoined and slotted symmetrically opposed materially pretensioned coplanar self-adjusting semirigid articulating arms are materially and structurally capable of expansively pivoting outwardly all the while forcefully seeking to continuously contract inwardly; i) wherein said symmetrically opposed materially pretensioned coplanar self-adjusting semirigid pivotal conjoined and slotted articulating arms, by inherently and continuously seeking to forcefully contract inwardly, ultimately self-adjust in unison to maximally encircle, compressively clench, support, and positively-hold any one of the respective and various non-standard neck and neck ring sizes which are broadly encountered among the spectrum of totable ubiquitous commercially manufactured plastic beverage bottles of a classified personal size; j) wherein said conjoined and slotted horizontally aligned semirigid carrier frame comprised of two symmetrically opposed materially pretensioned coplanar self-adjusting semirigid pivotal conjoined and slotted articulating arms is mated near to the top of a semirigid elongated vertical support frame; k) wherein said semirigid horizontal carrier frame of said semirigid self-adjusting clenching device shares a common vertical plane with said semirigid elongated vertical support frame of said reusable wearable positive-hold semirigid self-adjusting neck clenching support device; more specifically: 1) wherein said pair of semirigid symmetrically opposed coplanar self-adjusting semirigid pivotal conjoined materially pretensioned articulating arms of said slotted semirigid horizontal carrier frame are inherently endowed, structured, configured, and of an adequate thickness to both laterally expand and laterally contract to ultimately accommodate, clench, and respectively support the non-standardized neck and neck ring sizes typically encountered among the spectrum of totable ubiquitous commercially manufactured plastic beverage bottles of a classified personal size; 1) wherein said pair of semirigid symmetrically opposed coplanar self-adjusting semirigid pivotal conjoined materially pretensioned articulating arms of said slotted semirigid horizontal carrier frame are materially structured, configured, and of an adequate thickness to support the weighted contents typically encountered among the spectrum of totable ubiquitous commercially manufactured plastic beverage bottles of a classified personal size; 2) wherein the interior space situated between said pair of semirigid symmetrically opposed coplanar self-adjusting semirigid pivotal conjoined materially pretensioned articulating arms of said symmetrical semirigid slotted horizontal carrier frame of said symmetrical semirigid clenching device is configured with two overlapping apertures; 3) wherein said overlapping apertures may be circular as herein referenced; 4) wherein one said circular aperture of said symmetrical semirigid slotted horizontal carrier frame is proximal to said mated semirigid elongated vertical support frame wherein the other said circular aperture is distal from said mated semirigid elongated vertical support frame; 5) wherein said circular apertures situated within said interior space of said symmetrically opposed coplanar self-adjusting materially pretensioned semirigid pivotal articulating arms of said slotted semirigid horizontal carrier frame of said symmetrical semirigid bottle neck clenching device are of different diameters; 6) wherein the proximal circular aperture situated nearest to said semirigid elongated vertical support frame is diametrically configured to allow the greatest diametrically sized neck and neck ring sizes encountered among the spectrum of totable ubiquitous commercially manufactured plastic beverage bottles of a classified personal size to pass vertically through said proximal circular aperture unimpeded; 7) wherein said conjoined semirigid symmetrically opposed coplanar self-adjusting materially pretensioned semirigid pivotal articulating arms of said symmetrical semirigid slotted horizontal carrier frame, mated near to the top of said semirigid elongated vertical support frame, do not encroach on said proximal circular aperture situated nearest to said semirigid elongated vertical support frame; 8) wherein each distal end of each said semirigid symmetrically opposed coplanar self-adjusting materially pretensioned semirigid pivotal articulating arm of said semirigid slotted horizontal carrier frame contact one another when said reusable wearable positive-hold semirigid self-adjusting neck clenching device is in an unloaded static state or when said materially pretensioned semirigid symmetrically opposed coplanar self-adjusting materially pretensioned semirigid coplanar articulating arms of said semirigid slotted horizontal carrier frame are otherwise operationally engaged in clenching the least diametrically sized neck relative to the spectrum of totable ubiquitous commercially manufactured plastic beverage bottles of a classified personal size; 9) wherein said overlapping circular apertures are thereby congruous with said pair of semirigid symmetrically opposed coplanar self-adjusting semirigid pivotal conjoined materially pretensioned articulating arms of said symmetrical semirigid slotted horizontal carrier frame of said symmetrical semirigid bottle neck clenching device; 10) wherein said overlapping of said congruous circular apertures situated within said interior space of said materially pretensioned semirigid symmetrically opposed coplanar pivotal articulating arms of said symmetrical semirigid slotted horizontal carrier frame of said reusable wearable positive-hold semirigid self-adjusting bottle neck clenching device are configured to form a channelized pass-through opening from one said congruous circular aperture to the other said congruous circular aperture; 11) wherein said overlapping of said congruous circular apertures naturally creates a set of symmetrically opposed protuberances extending into said channelized pass-through opening leading from one said congruous circular aperture to the other said congruous circular aperture of said symmetrical semirigid slotted horizontal carrier frame of said reusable wearable positive-hold semirigid self-adjusting clenching device; 12) wherein each said symmetrically opposed protuberance extending into said channelized pass-through opening leading from one said congruous circular aperture to the other said congruous circular aperture of said symmetrical semirigid slotted horizontal carrier frame of said reusable wearable positive-hold semirigid self-adjusting neck clenching device project equally out from the inside face of each said semirigid symmetrically opposed coplanar self-adjusting materially pretensioned semirigid pivotal articulating arm into said channelized pass-through opening; 13) wherein said symmetrically opposed protuberances projecting equally into said channelized pass-through opening of said semirigid slotted horizontal carrier frame of said self-adjusting neck clenching device reactively causes said slotted materially pretensioned semirigid symmetrically opposed coplanar articulating arms to substantially, laterally, and expansively pivot outwardly when a neck of any diametrical size from among the spectrum of a ubiquitous commercially manufactured plastic beverage bottles of a classified personal size is being forced by an end user from one said congruous circular aperture into the other said congruous circular aperture; 14) wherein said overlapping circular apertures being congruous with said pair of semirigid symmetrically opposed coplanar self-adjusting semirigid pivotal conjoined materially pretensioned articulating arms thereby reactively and diametrically articulate in unison with said pair of semirigid symmetrically opposed coplanar self-adjusting semirigid pivotal conjoined materially pretensioned articulating arms of said symmetrical semirigid slotted horizontal carrier frame of said symmetrical semirigid neck clenching device; 15) wherein said facilitation slot of said substantially and laterally outwardly pivoting conjoined and slotted materially pretensioned semirigid symmetrically opposed coplanar articulating arms reactively widens in like kind when said slotted materially pretensioned semirigid symmetrically opposed coplanar articulating arms substantially, laterally, and expansively pivot outwardly when a neck of any diametrical size from a spectrum of a ubiquitous commercially manufactured plastic beverage bottles of a classified personal size is being forced by an end user from one said congruous circular aperture into the other said congruous circular aperture; 16) wherein upon subsequent contraction each said symmetrically opposed protuberance extending equally into said channelized pass-through of each said self-adjusting materially pretensioned conjoined articulating arms of said symmetrical semirigid slotted horizontal carrier frame serves as a means to assure the spectrum of non-standardized bottle necks encountered among totable ubiquitous commercially manufactured plastic beverage bottles of a classified personal size are continuously and forcefully maximally encircled, thereby maximally clenched, and thereby assuredly retained when a neck of any diametrical size encountered among the spectrum of totable ubiquitous commercially manufactured plastic beverage bottles of a classified personal size has entered into said distal congruous circular aperture; 17) wherein said contracted distal congruous circular aperture, configured with said facilitation slot situated furthest from said semirigid elongated vertical support frame, provides said materially pretensioned semirigid symmetrically opposed coplanar pivotal articulating arms, acting in unison with said set of symmetrically opposed protuberances situated within said channelized pass-through opening of said semirigid slotted horizontal carrier frame of said reusable wearable positive-hold semirigid self-adjusting clenching device, with the collective, inherent, material, and structural capability to forcefully and maximally encircle, and therefore continuously clench, positively retain, and respectively support the least to the largest diametrically sized neck and neck rings encountered among the spectrum of totable ubiquitous commercially manufactured plastic beverage bottles of a classified personal size; 18) wherein said materially pretensioned semirigid coplanar conjoined and slotted articulating arms of said reusable wearable positive-hold semirigid clenching device inherently endowed with the inherent material capability to spread expansively apart all the while continuously seeking to forcefully contract inwardly thereby maximally encircles, self-adjusts, clamps, clenches, supports, positively retains, and ultimately enables an end user to tote a ubiquitous commercially manufactured plastic beverage bottle of a classified personal size about the neck regardless of either the neck or neck ring sizes commonly encountered among the spectrum of commercially manufactured plastic beverage bottles of a classified personal size; 19) wherein said contracted congruous distal circular aperture situated furthest from said semirigid elongated vertical support frame, acting in unison with said slotted materially pretensioned semirigid symmetrically opposed coplanar articulating arms and said symmetrically opposed protuberances projecting equally into said channelized pass-through opening of said semirigid horizontal carrier frame of said self-adjusting clenching device is thereby diametrically and structurally configured to maximally, universally, and continuously encircle, clench, clamp, and support the spectrum of neck and neck ring sizes typically encountered among ubiquitous commercially manufactured plastic beverage bottles of a classified personal size when the neck of a ubiquitous commercially manufactured plastic beverage bottles of a classified personal size has been forced by an end user into said contracted congruous distal circular aperture; 20) wherein said semirigid elongated vertical support frame of said semirigid self-adjusting clenching device is inherently and materially endowed, structured, configured, and of an adequate thickness to support the weighted contents typically encountered among the spectrum of totable ubiquitous commercially manufactured plastic beverage bottles of a classified personal size; 21) wherein said semirigid elongated vertical support frame of said semirigid self-adjusting clenching device is configured to be slidable behind an accoutrement such as a belt, waistband, pocketbook strap, shirt collar, or pocket rim.

2. The reusable wearable positive-hold semirigid clenching device for the hands-free toting of the diverse array of ubiquitous commercially manufactured plastic beverage bottles of a classified personal size of claim 1;

1) wherein said semirigid elongated vertical support frame is comprised of a pair of symmetrically opposed semirigid coplanar torsional capable struts;
2) wherein said symmetrically opposed semirigid coplanar torsional capable struts are conjoined at the lowermost region of said semirigid elongated vertical support frame;
3) wherein said proximal ends of said pair of semirigid symmetrically opposed coplanar self-adjusting semirigid pivotal conjoined materially pretensioned articulating arms of said symmetrical semirigid horizontal carrier frame are correspondingly mated to and thereby supported near to the uppermost ends of said symmetrically opposed semirigid coplanar torsional capable struts of said symmetrical elongated semirigid vertical support frame of said reusable wearable positive-hold semirigid clenching device;
4) wherein said correspondingly mated uppermost ends of said symmetrically opposed semirigid coplanar torsional capable struts of said symmetrical elongated semirigid vertical support frame of said reusable wearable positive-hold semirigid clenching device are thereby configured to torsionally and reactively twist congruously when said corresponding pair of semirigid symmetrically opposed coplanar self-adjusting semirigid pivotal conjoined materially pretensioned slotted articulating arms of said of symmetrical semirigid horizontal carrier frame are substantially, laterally, and expansively pivoting outwardly.

3. The reusable wearable positive-hold semirigid clenching device for the hands-free toting of the diverse array of ubiquitous commercially manufactured plastic beverage bottles of a classified personal size of claim 1 or claim 2;

1) wherein said proximal conjoined ends of said materially pretensioned semirigid coplanar conjoined and slotted articulating arms of said symmetrical semirigid horizontal carrier frame are symmetrically configured with sockets;
2) wherein said uppermost ends of said symmetrically opposed semirigid coplanar torsional capable struts of said symmetrical elongated semirigid vertical support frame are configured with symmetrically opposed socket receptacles on or near the uppermost ends of said semirigid coplanar torsional capable struts of said symmetrical elongated semirigid vertical support frame;
3) wherein said sockets symmetrically configured on said proximal conjoined end of said symmetrical semirigid horizontal carrier frame correspond with said symmetrically opposed socket receptacles configured on or near the uppermost ends of said symmetrically opposed semirigid coplanar torsional capable struts of said symmetrical elongated semirigid vertical support frame;
4) wherein said sockets of said symmetrically opposed semirigid coplanar torsional capable struts of said symmetrical elongated semirigid vertical support frame thereby allow said symmetrically opposed sockets configured on said proximal ends of said pair of semirigid symmetrically opposed coplanar self-adjusting semirigid pivotal conjoined materially pretensioned articulating arms of said symmetrical semirigid horizontal slotted carrier frame to be temporarily mated with, and thereby retained, braced, and supported by said symmetrically opposed socket receptacles configured on the uppermost ends of said symmetrically opposed semirigid coplanar torsional capable struts of said symmetrical elongated semirigid vertical support frame;
5) wherein by virtue of said sockets of said proximal ends of said pair of semirigid symmetrically opposed coplanar self-adjusting semirigid pivotal conjoined materially pretensioned articulating arms and said sockets of said symmetrically opposed semirigid coplanar torsional capable struts of said symmetrical elongated semirigid vertical support frame is said symmetrical semirigid slotted horizontal carrier frame thereby configured to be separable from said symmetrically opposed coplanar torsional capable struts of said elongated semirigid vertical support frame;
6) wherein the outside face of said symmetrically opposed coplanar torsional capable struts of said symmetrical elongated semirigid vertical support frame are further configured with protuberances corresponding to said symmetrically opposed sockets configured on said proximal conjoined end of said symmetrical semirigid horizontal carrier frame;

7) wherein said symmetrically opposed sockets configured on said proximal conjoined end of said symmetrical semirigid horizontal carrier frame are therefore configured to be temporarily mated with said corresponding protuberances of said symmetrically opposed coplanar torsional capable struts of said symmetrical elongated semirigid vertical support frame;

8) wherein said separable, socketed, symmetrical semirigid horizontal carrier frame may therefore be collapsed, mated, stowed, and thereby temporarily retained on said protuberances configured on said semirigid coplanar torsional capable struts of said symmetrical semirigid vertical support frame of said reusable wearable positive-hold semirigid clenching device.

4. The reusable wearable positive-hold semirigid clenching device for the hands-free toting of the diverse array of ubiquitous commercially manufactured plastic beverage bottles of a classified personal size of claim 1;

1) wherein said materially pretensioned semirigid coplanar conjoined and slotted articulating arms of said symmetrical semirigid horizontal carrier frame are configured with presser protuberances projecting tangentially from the distal face of said materially pretensioned semirigid coplanar conjoined and slotted articulating arms of said symmetrical semirigid horizontal carrier frame;

2) wherein said tangentially projecting presser protuberances are situated equally to either side of said facilitation slot of said materially pretensioned semirigid coplanar conjoined and slotted articulating arms of said symmetrical semirigid horizontal carrier frame;

3) wherein the outer regions of said presser protuberances tangentially projecting equally to either side of said facilitation slot of said materially pretensioned semirigid coplanar conjoined and slotted articulating arms of said symmetrical semirigid horizontal carrier frame are configured with indents;

4) wherein said indents of said presser protuberances tangentially projecting to either side of said facilitation slot of said materially pretensioned semirigid coplanar conjoined and slotted articulating arms of said symmetrical semirigid horizontal carrier frame may be outfitted with a supplemental elasticized tensioning means such as an O-ring;

5) wherein said supplemental elasticized tensioning means spans across said facilitation slot of said materially pretensioned semirigid coplanar conjoined and slotted articulating arms of said symmetrical semirigid horizontal carrier frame;

6) wherein said supplemental elasticized tensioning means spanning said facilitation slot of said materially pretensioned semirigid coplanar conjoined and slotted articulating arms of said symmetrical semirigid slotted horizontal carrier frame is retained by said indents of said presser protuberances tangentially projecting to either side of said facilitation slot of said materially pretensioned semirigid coplanar conjoined and slotted articulating arms of said symmetrical semirigid horizontal carrier frame.

5. The reusable wearable positive-hold semirigid clenching device for the hands-free toting of the diverse array of ubiquitous commercially manufactured plastic beverage bottles of a classified personal size of claim 1 or claim 2;

1) wherein said semirigid elongated vertical support frame comprises a self-stowing semirigid coplanar bendable belt-brake appendage;

2) wherein said self-stowing semirigid coplanar bendable belt-brake appendage is centrally situated within the interior confines of said elongated vertical support frame;

3) wherein said centrally situated self-stowing semirigid coplanar belt-brake bendable appendage is conjoined to the lowermost region of said semirigid elongated vertical support frame;

4) wherein said centrally situated self-stowing semirigid coplanar bendable belt-brake appendage conjoined to the lowermost region of said semirigid elongated vertical support frame emanates upward to near the top of said semirigid elongated vertical support frame;

5) wherein said centrally situated self-stowing semirigid coplanar bendable belt-brake appendage conjoined to the lowermost region of said semirigid elongated vertical support frame emanating upward to near the top of said semirigid elongated vertical support frame does not interfere with said materially pretensioned semirigid coplanar conjoined and slotted articulating arms of said symmetrical semirigid horizontal carrier frame;

6) wherein said centrally situated self-stowing semirigid coplanar bendable belt-brake appendage conjoined to the lowermost region of said semirigid elongated vertical support frame functions independently from said elongated vertical support frame;

7) wherein said centrally situated self-stowing semirigid coplanar belt-brake appendage conjoined to the lowermost region of said semirigid elongated vertical support frame being bendable is thereby configured to maximally engage belted accoutrements of diverse widths and thicknesses;

8) wherein the body-side face of said centrally situated self-stowing semirigid coplanar belt interacting bendable belt-brake appendage may be optionally engaged by an end user with the outer face of a belted accoutrement to ensure said reusable wearable positive-hold semirigid clenching device does not become dislodged from a belted accoutrement of an end user when retaining the neck of a ubiquitous commercially manufactured plastic beverage bottle of a classified personal size and its weighted contents;

9) wherein said interaction of said centrally situated self-stowing semirigid coplanar bendable belt-brake appendage with a belted accoutrement of an end user does not prohibit a ubiquitous commercially manufactured plastic beverage bottle of a classified personal size from being either manually inserted into, or manually removed from said materially pretensioned circular apertures of said symmetrical semirigid horizontal carrier frame of said reusable wearable positive-hold semirigid clenching device by end user applied forces.

* * * * *